United States Patent [19]

Fujimoto et al.

[11] Patent Number: 4,966,111

[45] Date of Patent: Oct. 30, 1990

[54] FUEL SUPPLY CONTROL SYSTEM FOR INTERNAL COMBUSTION ENGINES

[75] Inventors: Sachito Fujimoto; Takuya Sugino; Shunji Takahasi; Makoto Hashiguchi, all of Wako, Japan

[73] Assignee: Honda Giken Kogyo K.K., Tokyo, Japan

[21] Appl. No.: 384,566

[22] Filed: Jul. 24, 1989

[30] Foreign Application Priority Data

Aug. 2, 1988 [JP] Japan ..... 63-192946

[51] Int. Cl.[5] ..... F02D 41/16

[52] U.S. Cl. ..... 123/399; 74/860

[58] Field of Search ..... 123/339, 340, 585, 587; 74/860, 873

[56] References Cited

U.S. PATENT DOCUMENTS 4,649,878 3/1987 Otobe et al. ..... 123/339
4,742,807 5/1988 Sakamoto et al. ..... 123/339
4,748,951 6/1988 Manaka et al. ..... 123/339
4,760,823 8/1988 Yasuoka et al. ..... 123/339
4,879,982 11/1989 Itakura et al. ..... 123/339

FOREIGN PATENT DOCUMENTS 0249645 12/1985 Japan .

*Primary Examiner*—Willis R. Wolfe
*Attorney, Agent, or Firm*—Arthur L. Lessler

[57] ABSTRACT

A fuel supply control system for an internal combustion engine, wherein when the engine is at idle, a correction value is determined based on a difference between a desired idling engine rotational speed and an actual engine rotational speed, and an amount of fuel to be supplied to the engine is corrected by the determined correction value. Correction valve-changing means sets a rate of change in the correction value relative to a change in the difference to a greater value when the detecting means detects that the engine means is not engaged with the transmission of an automotive vehicle, and to a smaller value when the detecting means detects that the engine is engaged with the transmission.

8 Claims, 2 Drawing Sheets

| FIG. 2A |
|---|
| FIG. 2B |

FUEL SUPPLY CONTROL SYSTEM FOR INTERNAL COMBUSTION ENGINES

BACKGROUND OF THE INVENTION

This invention relates to a fuel supply control system for internal combustion engines, and more particularly to a system of this kind in which the amount of fuel to be supplied to an internal combustion engine, which is determined based on engine operating conditions, is increased or decreased depending on variations in the engine rotational speed when the engine is at idle to thereby stabilize the engine rotational speed of the engine at idle.

Conventionally, fuel supply control systems for internal combustion engines are proposed e.g. by Japanese Provisional Patent Publication (Kokai) No. 60-249645 and Japanese Provisional Patent Publication (Kokai) No. 61-277837, in which when the engine is at idle, the difference between a desired idling engine rotational speed (e.g. an average value of engine rotational speed values at idle) and an actual engine rotational speed is determined, and the amount of fuel to be increased or decreased is determined based on the determined difference, to thereby increase the amount of fuel to be supplied to the engine by the determined fuel amount when the engine rotational speed is below the desired idling engine rotational speed and hence increase the engine rotational speed, and on the other hand decrease the amount of fuel to be supplied to the engine by the determined amount when the engine rotational speed is above the desired idling engine rotational speed and hence decrease the engine rotational speed, whereby the idling engine rotational speed is stabilized.

More specifically, in the above proposed fuel supply control systems, the amount of fuel to be increased or decreased is obtained by multiplying the difference between the desired idling engine rotational speed and the actual engine rotational speed by a predetermined coefficient. Accordingly, as the difference increases, the amount of fuel to be increased or decreased is increased in proportion to the increased difference, so that the engine rotational speed approaches the desired idling engine rotational speed more rapidly. Further, by setting the predetermined coefficient at a relatively great value, i.e. by setting the feedback gain at a greater value, the engine rotational speed approaches the desired idling engine rotational speed further more rapidly.

In the meanwhile, it is widely known that, in an internal combustion engine, the responsiveness of the engine rotational speed to a change in the amount of fuel supplied to the engine depends on whether or not the engine is engaged with the driving system of a vehicle on which the engine is installed, such as a clutch and a transmission.

More specifically, in the case where the fuel supply is increased to increase the engine rotational speed, there is a time lag, which is peculiar to the feedback system, from the time point of increasing the fuel supply, at which the engine output starts to increase, to the time point of actual increase in the engine rotational speed. This time lag depends on the scale of the feedback system. When the engine is not engaged with the driving system of the vehicle, as in the case of stoppage of the vehicle, the scale of the feedback system is relatively small, i.e. the operation steps of the feedback system comprise a shorter sequence of increasing (or decreasing) the fuel supply - rise (fall) in the engine torque - increase (decrease) in the engine rotational speed, so that the time lag is relatively small. On the other hand, when the engine is engaged with the driving system of the vehicle, as in the case of the vehicle running at a low speed with the throttle valve fully closed, the scale of the feedback system is relatively large, i.e. the operation steps of the feedback system comprise an extended sequence of increasing (or decreasing) the fuel supply - rise (fall) in the engine torque - increase (decrease) in the engine rotational speed which is associated with increase (decrease) in the rotational speed of driving wheels caused by way of the driving system of the vehicle by the increased (decreased) engine torque, so that the time lag is relatively large. Therefore, if the abovedescribed feedback fuel supply control responsive to the difference between the desired idling engine rotational speed and the actual engine rotational speed is carried out when the feedback system is associated with rotation of driving wheels driven by way of the driving system by the engine, for example, rise in the engine rotational speed to be caused by increase in the fuel supply takes place only after the rotational speed of driving wheels, i.e. the vehicle speed, has increased through increase in the engine output torque. A similar difference in time lag in the control due to different scales of the feedback system to that stated above also occurs when the fuel supply is decreased to decrease the engine rotational speed.

However, in the above fuel supply control systems, the feedback gain in the fuel supply control is set at a relatively great value so that the engine rotational speed approaches the desired idling engine rotational speed more rapidly when the engine is not engaged with the driving system. Therefore, if this relatively great value of feedback gair is applied when the engine is engaged with the driving system, i.e. when the time lag in the feedback control is longer, the engine rotational speed control by relatively large fuel supply through correction of the fuel supply by the relatively large gain continues to be carried out for a longer period of time until the engine rotational speed is actually changed, which may result in hunting of the engine rotational speed.

SUMMARY OF THE INVENTION

It is the object of the invention to provide a fuel supply control system which is capable of controlling the engine rotational speed at idle of the engine to a desired idling engine rotational speed more rapidly irrespective of whether the engine is engaged with the driving system of the vehicle, to thereby achieve a stable idling engine rotational speed which is free from hunting.

In order to attain the above object, the present invention provides a fuel supply control system for an internal combustion engine, the engine being installed on an automotive vehicle, the automotive vehicle having a driving system connected to the engine, wherein when the engine is at idle, an amount of fuel to be supplied to the engine is determined depending on operating conditions of the engine, a correction value is determined based on a difference between a desired idling engine rotational speed and an actual engine rotational speed, and the determined amount of fuel is corrected by the determined correction value to thereby supply a corrected amount of fuel to the engine.

The fuel supply control system according to the present invention is characterized by an improvement comprising:

detecting means for detecting whether the engine is engaged with the driving system of the automotive vehicle, and correction value-changing means for setting a rate of change in said correction value relative to a change in said difference to a greater value when said detecting means detects that said engine is not engaged with said driving system, and to a smaller value when said detecting means detects that said engine is engaged with said driving system.

The invention is particularly advantageous if applied to a fuel supply control system in which the correction value is determined by multiplying the difference between the desired idling engine rotational speed and the actual engine rotational speed by a predetermined coefficient. ystem.

The above and other objects, features, and advantages of the invention will become more apparent from the ensuing detailed description taken in conjunction with the accompanying drawings.

DETAILED DESCRIPTION

The invention will be described in detail with reference to the drawings showing an embodiment thereof.

Figure 1:
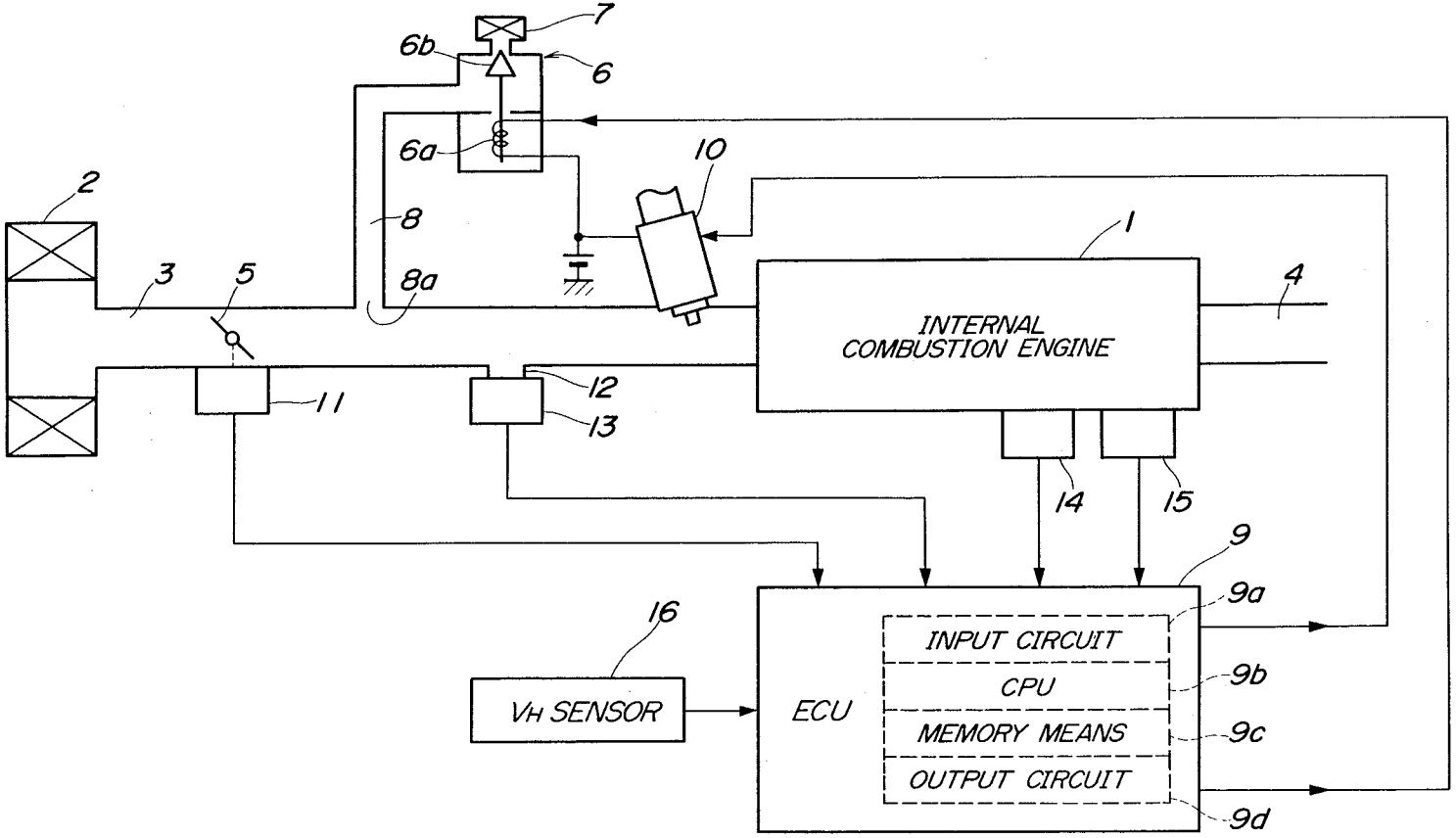
FIG. 1 is a schematic diagram showing the whole arrangement of a fuel supply control system for an internal combustion engine according to the invention.

Referring first to FIG. 1, there is illustrated a fuel supply control system according to an embodiment of the invention. In the figure, reference numeral 1 designates an internal combustion engine which may be a four-cylinder type, for example. Connected to the engine 1 are an intake pipe 3 provided with an air cleaner at an open end thereof, and an exhaust pipe. Arranged in the intake pipe 3 is a throttle valve 5, which is bypassed by an air passage 8 with one end 8*a* thereof opening into the interior of the intake pipe 3 at a downstream side of the throttle valve 5, and the other end communicating with the atmosphere and provided with an air cleaner 7. Arranged across the air passage 8 is an auxiliary air control valve (hereinafter simply referred to as "the AIC control valve") 6, which is a normally-closed type solenoid valve which may be formed of a linear solenoid 6*a*, and a valve body 6*b* disposed to open the air passage 8 when the solenoid 6*a* is energized, the solenoid 6*a* being electrically connected to an electronic control unit (hereinafter referred to as "the ECU") 9.

Fuel injection valves 10, only one of which is shown, are mounted in the intake pipe 3 at locations between the engine 1 and the open end 8*a* of the air passage 8, and are mechanically connected to a fuel pump, not shown, and also electrically connected to the ECU 9.

A throttle opening ($\theta_{TH}$) sensor 11 is connected to the throttle valve 5. An absolute pressure ($P_{BA}$) sensor 13 is provided in communication with the intake pipe 3 through a conduit 12 at a location downstream of the open end 8*a* of the air passage 8. An engine coolant temperature ($T_W$) sensor 14 and an engine rotational speed (Ne) sensor 15 are mounted on the engine 1, and are electrically connected to the ECU 9.

The engine rotational speed sensor 15 generates a pulse (hereinafter referred to as "the TDC signal pulse") at a predetermined crank angle position before a top dead center (TDC) at the start of suction stroke of each cylinder, whenever the engine crankshaft rotates through 180 degrees, and supplies the TDC signal to the ECU 7.

Further electrically connected to the ECU 9 is a vehicle speed ($V_H$) sensor 16 for detecting the vehicle speed ($V_H$), which supplies a signal indicative of the vehicle speed ($V_H$) to the ECU 9.

The ECU 9 comprises an input circuit 9*a* having the functions of shaping the waveforms of input signals from various sensors, shifting the voltage levels of sensor output signals to a predetermined level, converting analog signals from analog-output sensors to digital signals, and so forth, a central processing unit (hereinafter referred to as "the CPU") 9*b*, memory means 9*c* storing various operational programs which are executed in the CPU 9*b* and for storing results of calculations therefrom, etc., and an output circuit 9*d* which outputs driving signals to the fuel injection valves 10 and the AIC control valve 6.

In this embodiment, the ECU 9 forms detecting means for detecting whether the engine is engaged with the driving system, correction value-changing means, and nullifying means for nullifying a correction value.

The CPU 9*b* operates in response to signals from the above-mentioned sensors to determine whether the engine is in a predetermined idling condition in which the feedback control of the idling engine rotational speed through control of an intake air amount (hereinafter simply referred to as "the AIC control") should be carried out, and calculates, based upon the determined operating condition, a current amount (control amount) I to be supplied to the linear solenoid 6*a* of the AIC control valve 6 in synchronism with inputting of TDC signal pulses to the ECU 9. In this connection, the feedback control amount $I_{FB}$ of the current amount I in the predetermined idling condition of the engine may be obtained by a known method, e.g. by determining the difference between a desired idling engine rotational speed $N_{IC}$ and an actual engine rotational speed Ne.

On the other hand, the CPU 9*b* of the ECU 9 operates in response to the above-mentioned signals from the sensors to determine operating conditions in which the engine I is operating, such as an idling condition, and calculates, based upon the determined operating conditions, the valve opening period or fuel injection period $T_{OUT}$ over which the fuel injection valves 6 are to be opened, by the use of the following equations (1) and (2) in synchronism with inputting of TDC signal pulses to the ECU 9.

$$T_{OUT}=Ti\times K_1+K_2 \quad (1)$$

$$T_{OUT}=T_{OUT}+T_{AIC} \quad (2)$$

where Ti represents a basic value of the fuel injection period $T_{OUT}$ of the fuel injection valves 6, which is determined based upon the engine rotational speed Ne and the intake pipe absolute pressure $P_{BA}$ within the intake pipe 3. $K_1$ and $K_2$ are correction coefficients and correction variables, respectively, which are calculated based upon various engine parameter signals from the above-described sensors, i.e. the throttle valve opening sensor 11, the intake pipe absolute pressure sensor 13, the engine rotational speed sensor 15, and other operating condition parameter sensors, not shown, to such values as to optimize characteristics of the engine, such as startability, fuel consumption, and accelerability, by the use of predetermined equations.

Further, $T_{OUT}$ on the right side of the equation (2) is a fuel injection period obtained by the equation (1), to which is added $T_{AIC}$ to give a new value of $T_{OUT}$. $T_{AIC}$ is a fuel amount correction variable according to the invention, which is set to a value obtained by the following equation (3) during the feedback control of the idling engine rotational speed through control of fuel supply (hereinafter simply referred to as "the TAIC control"), referred to hereinafter, and dependent on the difference between an actual engine rotational speed Ne and an average value $Ne_{AVE}$ of values of engine rotational speed assumed during idling of the engine as a desired idling engine rotational speed:

$$T_{AIC}=\alpha_{Me}\times(Me-Me_{AVE}) \quad (3)$$

where Me is a value corresponding to the reciprocal of the engine rotational speed Ne used in the ECU 9 in place of the engine rotational speed Ne for the convenience of processing, and represents the time interval between generation of one TDC signal pulse and generation of the immedintely following TDC signal pulse. As the engine rotational speed is higher, the value of Me is shorter. $Me_{AVE}$ is an average value of Me values calculated by the equation (4), referred to hereinafter. $\alpha_{Me}$ is a gain setting value for setting the feedback gain to be effected by the fuel amount correction variable $T_{AIC}$ for the fuel injection period $T_{OUT}$, and set to suitable values depending upon whether or not the engine is engaged with the driving system of the vehicle in a manner described in detail hereinafter.

The CPU 9b supplies the AIC control valve 6 and the fuel injection valves 10 through the output circuit 9d with respective driving signals for opening same respectively based on the current amount I and the fuel injection period $T_{OUT}$ obtained as described above.

Next, the feedback control of fuel supply during idling of the engine by the fuel supply control system according to the invention will be explained with reference to FIG. 2.

Figure 2A:
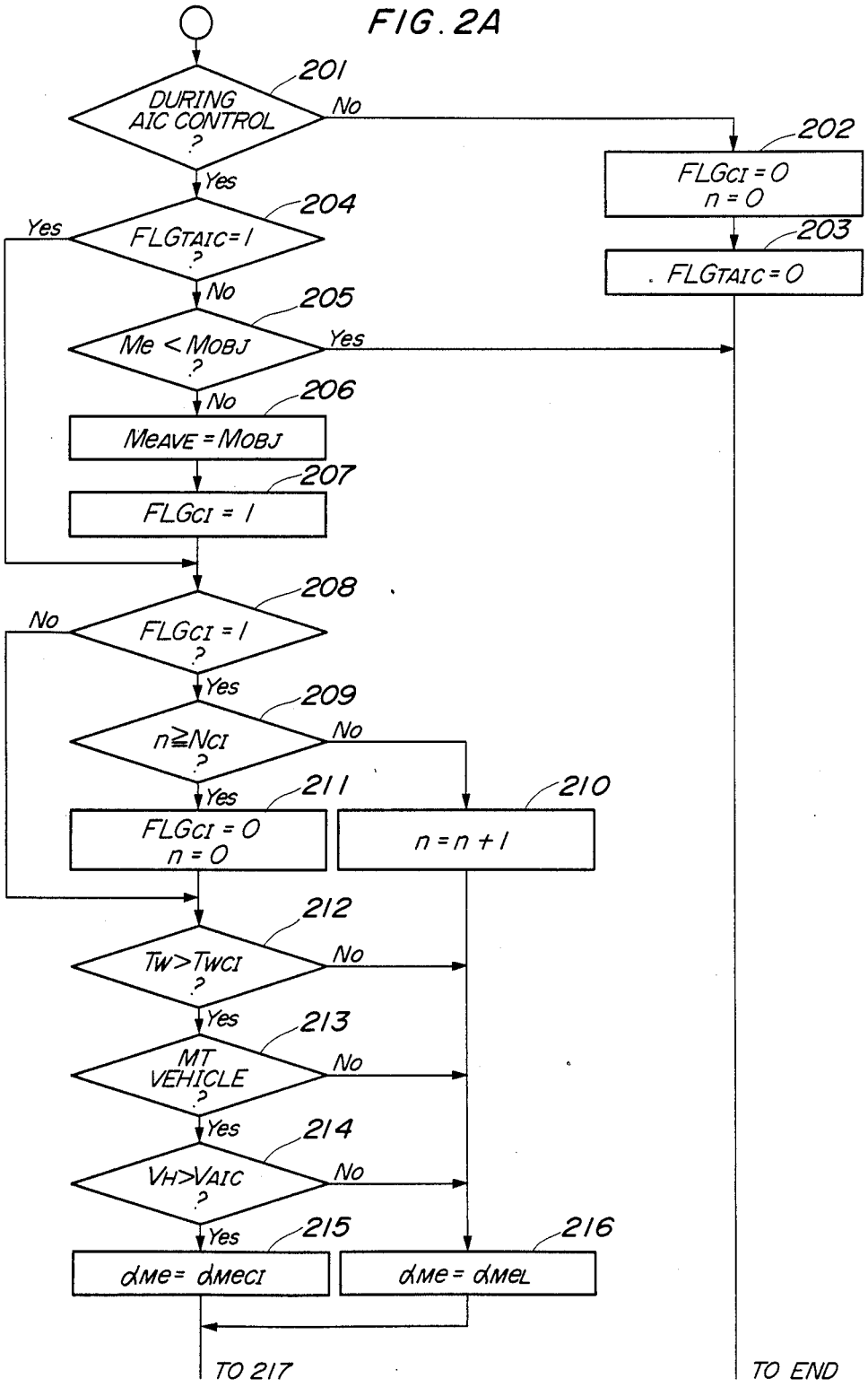
FIG. 2 is a flowchart showing a $T_{AIC}$ calculating subroutine for calculating a fuel amount correction variable $T_{AIC}$.
Figures 2, 2B:
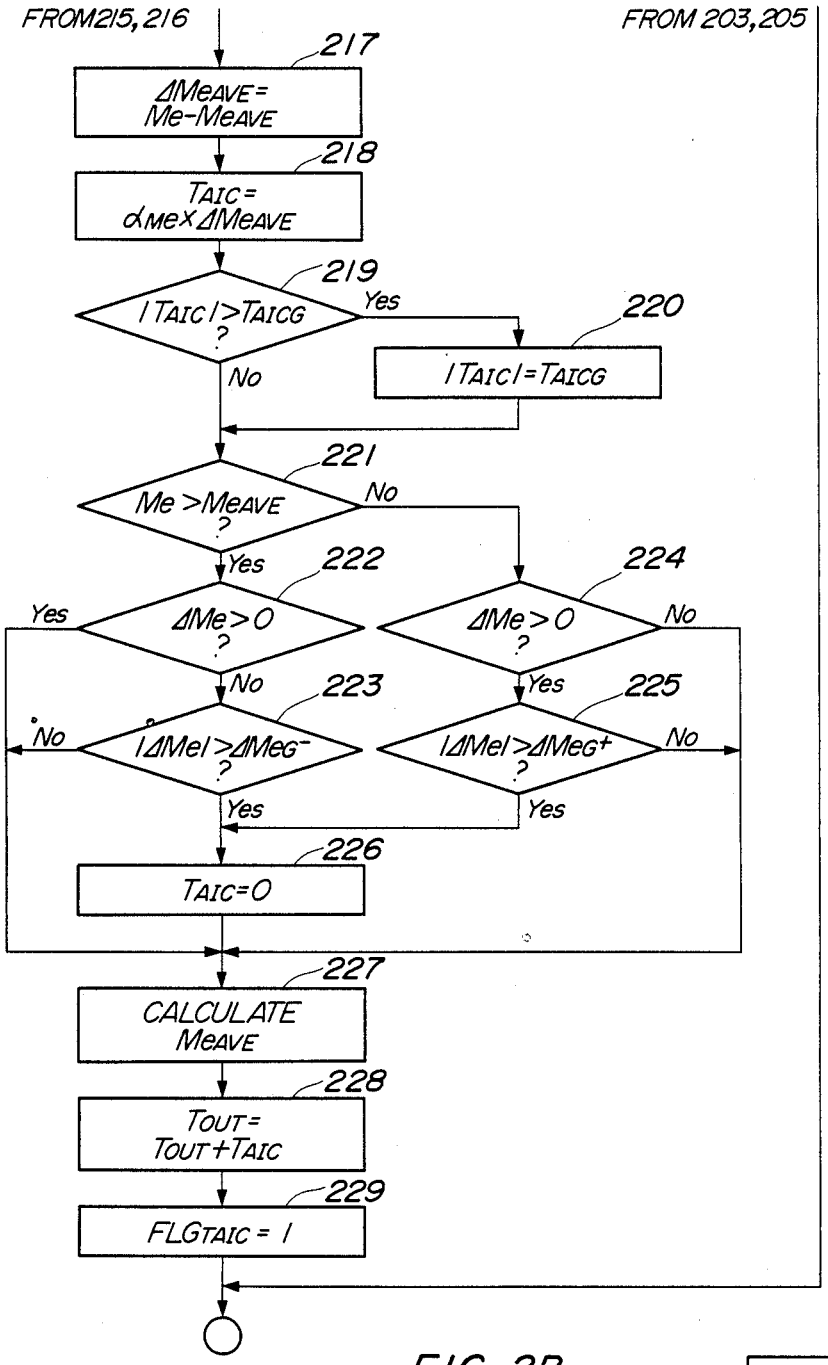

FIG. 2 shows a $T_{AIC}$ calculating program for setting the aforesaid fuel amount correction variable ($T_{AIC}$) to the value responsive to the difference between an actual engine rotational speed (Ne) and a desired idling engine rotational speed (an average value $Ne_{AVE}$ of engine rotational speed). The program is carried out by the CPU 9b whenever a TDC signal pulse is supplied to the ECU 9.

First, at a step 201, it is determined whether or not the AIC control by the use of the AIC control valve 6 is being carried out. The AIC control is started, e.g. when both two conditions are satisfied that the throttle valve opeing $\theta_{TH}$ assumes a value smaller than a predetermined value $\theta_{IDL}$ at and below which the throttle valve may be considered to be substantially fully closed, and the engine rotational speed Ne is lower than a predetermined value $N_A$ (e.g. 900 rpm).

If the answer to the question of the step 201 is No, i.e. if the AIC control is not being carried out since the above conditions are not satisfied, the program proceeds to a step 202 without carrying out the TAIC control at steps 204 et seq. At the step 202, the value of a first flag $FLG_{CI}$, referred to hereinafter, and the value of a control variable n are both set to 0, and at the following step 203, the value of a second flag $FLG_{TAIC}$, also referred to hereinafter, is set to 0, followed by terminating the present program.

If the answer to the question of the step 201 is yes, the program proceeds to a step 204, where it is determined whether or not the value of the second flag $FLG_{TAIC}$ is 1. The second flag $FLG_{TAIC}$ is for determining whether or not the TAIC control was actually carried out in the immediately preceding loop, and set to a value of 1 at a step 229, referred to hereinafter, after the TAIC control at steps 208 et seq., referred to hereinafter, is carried out. If the answer to the question of the step 204 is yes, i.e. if the TAIC control was carried out in the immediately preceding loop, the program skips over the following steps 205 to 207 to the steps 208 et seq. to continue the TAIC control.

If the answer to the question of the step 204 is No, i.e. if the $T_{AIC}$ control was not carried out in the immediately preceding loop, the program proceeds to the steps 205 to 207. First, at the step 205, it is determined whether or not the value Me is smaller than a value $M_{OBJ}$ corresponding to the reciprocal of a desired idling engine rotational speed $N_{OBJ}$ set in accordance with an engine temperature in the AIC control. If the answer to the question of the step 205 is yes, i.e. if the engine rotational speed Ne exceeds the desired idling engine rotational speed $N_{OBJ}$, it is judged that it is not necessary to carry out the $T_{AIC}$ control at the steps 208 et seq., and then the present program is terminated.

If the answer to the question of the step 205 is No, the program proceeds to a step 206, where the initial value of a value $Me_{AVE}$ (hereinafter simply referred to as "the average value $Me_{AVE}$") corresponding to the reciprocal of an average value $Ne_{AVE}$ of engine rotational speed as a desired idling engine rotational speed to be applied in the TAIC control is set to the value $M_{OBJ}$, and at the step 207, the value of the first flag $FLG_{CI}$ is set to 1, followed by the program proceeding to the steps 208 et seq.

In the TAIC control at the steps 208 et seq., first, at steps 208 to 216, it is determined whether the aforesaid gain setting value $\alpha_{Me}$ for determining the feedback gain by the fuel amount correction variable $T_{AIC}$ should be set to a first value $\alpha_{MeCI}$ (0.06) or a second value $\alpha_{MeL}$ (0.35).

At steps 208 to 211, in order to determine whether a predetermined time period has elapsed after the time point of start of the TAIC control (the time point at which the answer to the question of the step 205 has become No), it is determined at the step 208 whether or not the value of the first flag $FLG_{CI}$ is 1, and further at the step 209 whether or not the control variable n has reached a predetermined value $N_{CI}$ (e.g. 10). The control variable n is increased by an increment of 1 whenver the step 210 is carried out after the answer to the question of the step 209 has become No for the first time. Therefore, the answer to the question of the step 209 continues to be No over a certain time period until 10 TDC signal pulses have been generated after the start of the TAIC control, and in this loop, the gain setting value $\alpha_{Me}$ is set to the second value $\alpha_{MeL}$ at a step 216 to thereby set the feedback gain of the TAIC control to a greater value. This setting the feedback gain of the idling engine rotational speed to the greater value and holding same over the certain time period after the start of the TAIC control is based on the ground that when the engine rotational speed Ne is below the desired idling engine rotational speed $N_{OBJ}$ (the answer to the question of the step 205 is No) immediately after the start of the TAIC control, the engine rotational speed Ne may further drop to a much lower value if the feedback gain is small.

If the certain time period has elapsed after the start of the TAIC control (10 TDC signal pulses have been generated) to change the answer to the question of the step 209 to yes, the value of the first flag $FLG_{CI}$ the value of the control variable n are both set to 0 at a step 211, followed by the program proceeding to steps 212 et seq.

When the certain time period has elapsed after the start of the TAIC control, the value of the first flag $FLG_{CI}$ is set to 0, so that thereafter the answer to the question of the step 208 is No, and therefore the program skips over the steps 209 to 211 to steps 212 et seq.

At the step 212, it is determined whether or not the engine coolant temperature $T_W$ is higher than a predetermined value $T_{WCI}$ (e.g. 60° C.). If the answer to the question of the step 212 is No, it is judged that air supply control during starting of the engine is being carried out in which a great amount of intake air is supplied to the engine by means of a fast idling mechanism (e.g. the control valve 6) of the engine, and then the program proceeds to the step 216 where the gain setting value $\alpha_{Me}$ is set to the second value $\alpha_{MeL}$ to set the feedback gain of the TAIC control to the greater value without carrying out the following steps 213 and 214.

This setting the feedback gain to the greater value during operation of the fast idling mechanism is based on the ground that when a great amount of intake air is being supplied to the engine, the engine rotational speed Ne is controlled to a relatively high value, whereby sufficient engine output torque is obtained. More specifically, in this state, even if the engine is engaged with the driving system, the time lag of the feedback system from increasing/decreasing the fuel supply to actual increase/decrease in the engine rotational speed is relatively short. Therefore, there is no fear of the aforesaid hunting due to the time lag in the feedback system. Therefore, the feedback gain is set to the greater value during fast idling to thereby improve responsiveness of the engine rotational speed control.

If the answer to the question of the step 212 is Yes, the following steps 213 and 214 are carried out to determine whether or not the engine is engaged with the driving system of the vehicle. First, at the step 213, it is determined whether or not the vehicle on which the engine is installed is an MT vehicle, i.e. a vehicle equipped with a manual transmission, and then at the step 214 it is determined whether or not the vehicle speed $V_H$ is higher than a predetermined value $V_{AIC}$ (e.g. 10 km/h).

If both the answers to the questions of the steps 212 and 213 are Yes, i.e. if the vehicle is an MT vehicle and at the same time the vehicle speed $V_H$ is higher than the predetermined value $V_{AIC}$, it is considered that, normally, the engine is engaged with the driving system of the vehicle, so that the gain setting value $\alpha_{Me}$ is set to the first value $\alpha_{MeCI}$ at a step 215, followed by the program proceeding to steps 217 et seq.

On the other hand, if the answer to the question of the step 213 is No, i.e. if the vehicle is equipped with an automatic transmission, the second value $\alpha_{MeL}$ for setting the feeback gain tO the greater value is selected as the gain setting value $\alpha_{Me}$ at a step 216, since in an vehicle with an automatic transmission the driving system has a relatively small influence on the engine rotational speed due to intervention of a torque converter between the engine and the transmission, and therefore the time lag in the feedback system is not so long while the engine is engaged with the driving system. Then the program proceeds to the steps 217 et seq. Further, if the answer to the question of the step 214 is No, i.e. if the vehicle is an MT vehicle and at the same time the vehicle speed $V_H$ is not higher than the predetermined value $V_{AIC}$, considering that, normally, the driver disengages the clutch in order to avoid engine stalling at such a low vehicle speed, it is decided that the engine is not engaged with the driving system, so that the program proceeds to the step 216 where the gain setting value $\alpha_{Me}$ is set to the second value $\alpha_{MeL}$, followed by the program proceeding to the steps 217 et seq.

At a step 217, there is calculated a difference $\Delta Me_{AVE}$ between the average value $Me_{AVE}$ set at the step 206 or a step 227 referred to hereinafter and an Me value detected when the present TDC signal pulse is generated. Then at a step 218, by the equation (3), the difference $\Delta Me_{AVE}$ is multiplied by the gain setting value $\alpha_{Me}$ set at the step 215 or 216 to obtain the fuel amount correction variable $T_{AIC}$.

At a step 219, it is determined whether or not the absolute value $|T_{AIC}|$ of the fuel amount correction variable $T_{AIC}$ obtained at the step 218 is greater than a predetermined maximum allowable value $T_{AICG}$. If the answer to the question of the step 219 is Yes, the absolute value $|T_{AIC}|$ is corrected to the predetermined value $T_{AICG}$ at a step 220, followed by the program proceeding to a step 221. On the other hand, if the answer is No, the program immediately proceeds to the step 221.

At the step 221, it is determined whether or not the Me value is greater than the average value $Me_{AVE}$. If the answer to the question of the step 221 is Yes, i.e. if it is determined that the engine rotational speed Ne is lower than the average value $Ne_{AVE}$ of idling engine rotational speed, it is determined at a step 222 whether or not a variation ΔMe of the Me value is greater than 0. The variation ΔMe is obtained by subtracting a value $Me_{n-1}$ of the Me value obtained in the immediately preceding loop from a value $Me_n$ of the Me value obtained in the present loop ($=Me_n - Me_{n-1}$). If the variation ΔMe is positive, it means that the engine rotaional speed Ne is decreasing, and if the variation ΔMe is negative, it means that the engine rotational speed Ne is increasing. If the answer to the question of the step 222 is Yes, i.e. if the engine rotational speed Ne is decreasing away from the average value $Ne_{AVE}$, the program proceeds to a step 227 without carrying Out correction of the value $T_{AIC}$ at a step 226, referred to hereinafter.

At the step 227, the average value $Me_{AVE}$ of Me values obtained during idling of the engine is calculated by the following equation (4):

$$Me_{AVEn} = (M_{REF}/256) \times Me_n + [(256 - M_{REF})/256] \times Me_{AVEn-1} \quad (4)$$

where $Me_{AVEn}$ represents an average value of Me to be obtained in the present loop, and $Me_{AVEn-1}$ represents an average value of Me obtained in the immediately preceding loop. $M_{REF}$ is an averaging coefficient, which is set at a predetermined integral number of 0 to 256 based on the operating characteristics of the engine during idling thereof etc. $Me_n$ is, as referred to above, an Me value detected from the present TDC signal pulse. The initial value of $Me_{AVE}$ is, as described above, obtained at the step 206. The average value $Me_{AVE}$ thus calculated is stored into the memory means 9c shown in FIG. 1.

At the following step 228, the fuel injection period $T_{OUT}$ of the fuel injection valves 10 obtained by the equation (1) is corrected by the fuel amount correction coefficient $T_{AIC}$ by the equation (2) to obtain a corrected fuel injection period $T_{OUT}$. Then at the step 229, the second flag $FLG_{TAIC}$ is set to a value of 1 to indicate the fact that the TAIC control has been carried out in the present loop, followed by terminating the present program.

If the answer to the question of the step 222 is No, the program proceeds to a step 223, where it is determined whether or not the absolute value $|\Delta Me|$ of the variation $\Delta Me$ is greater than a predetermined value $\Delta Me_{G-}$. If the answer to the question of the step 223 is No, the program immediately proceeds to the steps 227 et seq. to increase the fuel supply by the $T_{AIC}$ value. On the other hand, if the answer to the question of the step 223 is Yes, i.e. if the engine rotaional speed Ne is rapidly increasing toward the desired idling speed, the program proceeds to the step 226, where the fuel amount correction variable $T_{AIC}$ is corrected to 0. Thus, even if the engine rotational speed Ne is below the desired idling engine rotational speed, the fuel amount correction by the variable $T_{AIC}$ is actually nullified when the rotational speed Ne is rapidly increasing, whereby overshooting of the rotational speed Ne above the desired idling engine rotational speed is prevented.

If the answer to the question of the step 221 is No, i.e. if the engine rotational speed Ne exceeds the average value $Ne_{AVE}$ or the desired idling engine rotational speed, the program proceeds to a step 224, where it is determined whether or not the variation $\Delta Me$ of Me is greater than 0. If the answer to the question of the step 224 is No, i.e. if the engine rotational speed Ne is increasing away from the average value $Ne_{AVE}$, the program immediately proceeds to the step 227 without correcting the $T_{AIC}$ at the step 226. On the other hand, if the answer to the question of the step 224 is Yes, it is further determined at a step 225 whether or not the absolute value $|\Delta Me|$ of the variation $\Delta Me$ is greater than a predetermined value $\Delta Me_{G+}$. If the answer to the question of the step 225 is No, the program immediately proceeds to the steps 227 et seq. to decrease the fuel supply by the variable $T_{AIC}$ obtained at the step 218. On the other hand, if the answer to the question of the step 225 is Yes, i.e. if the engine rotational speed Ne is rapidly falling toward the average value $Ne_{AVE}$, the program proceeds to the step 226, where the fuel amount correction variable $T_{AIC}$ is corrected to 0 to thereby stop the rapid decrease in the engine rotational speed Ne, followed by the program proceeding to the steps 227 et seq.

Although in the embodiment described above, it is decided that the engine is engaged with the driving system of the vehicle when the vehicle is equipped with a manual shifted transmission and at the same time the vehicle speed is above a predetermined value, this is not limitative, but the engagement between the engine and the driving system may be directly detected by a combination of detection of the shift gear position of the transmission and detection of engagement state of the clutch.

Further, although the above described embodiment is applied to an MT vehicle, wherein the feedback gain of the idling engine rotational speed control is changed depending on engagement between the engine and the driving system, the invention may be applied to an AT vehicle equipped with an automatic transmission, wherein the feedback gain may be similarly controlled depending on the engagement between the engine and the driving system.

Further, although in the embodiment, the fuel amount correction variable $T_{AIC}$ for the fuel supply control is calculated based on the difference between the actual engine rotational speed Ne and the average value $Ne_{AVE}$ of engine rotaional speed during idling of the engine, instead, the fuel amount correction varialbe $T_{AIC}$ may be calculated, e.g. based on the difference between the actual engine rotational speed and the desired idling engine rotational speed ($N_{OBJ}$) applied to the AIC control, or a variation $\Delta Ne$ of the engine rotational speed Ne.

What is claimed is:

1. In a fuel supply control system for an internal combustion engine, said engine being installed on an automotive vehicle, said automotive vehicle having a driving system connected to said engine, wherein when said engine is at idle, an amount of fuel to be supplied to said engine is determined depending on operating conditions of said engine, a correction value is determined based on a difference between a desired idling engine rotational speed and an actual engine rotational speed, and the determined amount of fuel is corrected by the determined correction value to thereby supply a corrected amount of fuel to said engine, the improvement comprising:

detecting means for detecting whether said engine is engaged with said driving system of said automotive vehicle, and correction value-changing means for setting a rate of change in said correction value relative to a change in said difference to a greater value when said detecting means detects that said engine is not engaged with said driving system, and to a smaller value when said detecting means detects that said engine is engaged with said driving system.

2. A fuel supply control system as claimed in claim 1, further including nullifying means for nullifying said correction value when said actual engine rotational speed is changing toward said desired idling engine rotational speed at a rate higher than a predetermined value.

3. A fuel supply control system as claimed in claim 1, wherein said correction value is determined by multiplying said difference between said desired idling engine rotational speed and said actual engine rotational speed by a predetermined coefficient.

4. A fuel supply control system as claimed in claim 3, wherein said predetermined coefficient assumes a first value when said detecting means detects that said engine is not engaged with said driving system, and a second value which is smaller than said first value when said detecting means detects that said engine is engaged with said driving system.

5. A fuel supply control system as claimed in claim 1 or 4, wherein said detecting means decides that said engine is engaged with said driving system when the speed of said automotive vehicle is higher than a predetermined value.

6. A fuel supply control sytem as claimed In claim 5, wherein said driving system comprises a manual transmission.

7. A fuel supply control system as claimed in calim 4, wherein said engine includes fast idling means, said predetermined coefficient assuming said first value when an engine coolant temperature is not higher than a predetermined value at and below which said fast idling means is operable, irrespective of whether said engine is engaged with said driving system.

8. A fuel supply control system as claimed in claim 4, wherein said predetermined coefficient assumes said first value until a predetermined time period elapses after said correction of said amount of fuel by said correction value is started, irrespective of whether said engine is engaged with said driving system.

* * * * *